US007731863B2

(12) United States Patent
Iyengar et al.

(10) Patent No.: US 7,731,863 B2
(45) Date of Patent: Jun. 8, 2010

(54) MAGNETORHEOLOGICAL FLUID WITH A FLUOROCARBON THICKENER

(76) Inventors: Vardarajan R. Iyengar, 51475 Willow Springs Dr., Macomb, MI (US) 48042; Sally M. Yurgelevic, 23040 Beechwood Ave., Eastpointe, MI (US) 48021; Robert T. Foister, 733 Spartan Dr., Rochester Hills, MI (US) 48309

( * ) Notice: Subject to any disclaimer, the term of this patent is extended or adjusted under 35 U.S.C. 154(b) by 333 days.

(21) Appl. No.: 11/827,492

(22) Filed: Jul. 12, 2007

(65) Prior Publication Data

US 2009/0014681 A1 Jan. 15, 2009

(51) Int. Cl.
*H01F 1/44* (2006.01)

(52) U.S. Cl. ..... 252/62.52

(58) Field of Classification Search ..... 252/62.52
See application file for complete search history.

(56) References Cited

U.S. PATENT DOCUMENTS

| | | | |
|---|---|---|---|
| 5,645,752 | A | 7/1997 | Weiss et al. |
| 6,203,717 | B1 | 3/2001 | Munoz et al. |
| 2004/0084263 | A1 | 5/2004 | Kintz et al. |

FOREIGN PATENT DOCUMENTS

| | | | |
|---|---|---|---|
| WO | 2004/042747 | | 5/2004 |
| WO | WO 2004/042747 | * | 5/2004 |

OTHER PUBLICATIONS

EP Search Report dated Oct. 17, 2008.

* cited by examiner

*Primary Examiner*—C. Melissa Koslow
(74) *Attorney, Agent, or Firm*—Dickinson Wright PLLC

(57) ABSTRACT

A magnetorheological fluid formulation comprising magnetizable particles dispersed in carrier fluid and a thixotropic agent wherein the thixotropic agent comprises a fluorocarbon grease.

23 Claims, No Drawings

MAGNETORHEOLOGICAL FLUID WITH A FLUOROCARBON THICKENER

FIELD OF THE INVENTION

This invention relates to magnetorheological fluids having a fluorocarbon thickener or thixotropic agent.

BACKGROUND OF THE INVENTION

Magnetorheological (MR) fluids are substances that exhibit an ability to change their flow characteristics by several orders of magnitude and in times on the order of milliseconds under the influence of an applied magnetic field. These induced rheological changes are completely reversible. The utility of these materials is that suitably configured electromechanical actuators which use magnetorheological fluids can act as a rapidly responding active interface between computer-based sensing or controls and a desired mechanical output. With respect to automotive applications, such materials are seen as a useful working media in shock absorbers, brakes for controllable suspension systems, vibration dampers in controllable power train and engine mounts and in numerous electronically controlled force/torque transfer (clutch) devices.

MR fluids are noncolloidal suspensions of finely divided (typically one to 100 micron diameter) low coercivity, magnetizable solids such as iron, nickel, cobalt, and their magnetic alloys dispersed in a base carrier liquid such as a mineral oil, synthetic hydrocarbon, water, silicone oil, esterified fatty acid or other suitable organic liquid. MR fluids have an acceptably low viscosity in the absence of a magnetic field but display large increases in their dynamic yield stress when they are subjected to a magnetic field of, e.g., about one Tesla. At the present state of development, MR fluids appear to offer significant advantages over other types of controllable fluids, such as ER fluids, particularly for automotive applications, because the MR fluids are relatively insensitive to common contaminants found in such environments, and they display large differences in rheological properties in the presence of a modest applied field.

A typical MR fluid in the absence of a magnetic field has a readily measurable viscosity that is a function of its vehicle and particle composition, particle size, the particle loading, temperature and the like. However, in the presence of an applied magnetic field, the suspended particles appear to align or cluster and the fluid drastically thickens or gels. Its effective viscosity then is very high and a larger force, termed a yield stress, is required to promote flow in the fluid.

Because MR fluids contain noncolloidal solid particles which are at least five times more dense than the liquid phase in which they are suspended, suitable dispersions of the particles in the liquid phase must be prepared so that the particles do not settle appreciably upon standing nor do they irreversibly coagulate to form aggregates. Without some means of stabilizing or suspending the solid, sedimentation and/or flow induced separation of the solid phase from the liquid phase will occur. Such separation will have a drastic and detrimental effect on the ability of the MR fluid to provide optimal and repeatable performance.

The magnetizable particles are kept in suspension by dispersing a thickener or thixotropic agent in the liquid vehicle. There are basically two approaches to the stabilization of MR fluids: the use of polymeric thickeners, such as high molecular weight hydrocarbons, polyureas, etc., or the use of a finely divided solid, such as fumed silica or colloidal clay. Essentially, both approaches aim to prevent separation of the liquid and solid phases by forming a thixotropic network which "traps" or suspends the heavier solid in the lighter liquid.

Fumed silica can be used as a stabilizer in MR fluid compositions, provided attention is given to the selection of fumed silica grades that are compatible with the chemistry of the liquid phase. This selection is complicated by the fact that the liquid phase is often a combination of miscible, but chemically different materials. If adequate shear mixing is achieved in processing, a lightly gelled system can be formulated using fumed silica. Although characterized by a "yield stress" (defined as the applied force/area required to initiate flow) sufficient to prevent settling, it has been shown that such a system will still flow with a moderate to low viscosity. However, one perceived disadvantage in using fumed silica is that this material, even in amounts less than two or three percent/volume, can cause the MR fluid to be abrasive towards polymeric seals as well as metallic wear surfaces in the device. This may be particularly detrimental in vehicle damper applications, where a considerable amount of expense and effort has been devoted to providing wear-resistant coatings, for example, to protect the damper from failure due to excessive wear. Also, there is growing evidence that fumed silica is a key factor contributing to "in-use thickening", or paste formation, of MR fluids in suspension dampers subjected to accelerated durability testing. Finally, fumed silicas are sensitive to the presence of contaminants, and their ability to form a network can be significantly compromised by certain contaminants.

Surface-treated, colloidal organoclay has also been used as a stabilizer for MR fluids. In contrast to polymeric thickeners, and similar to fumed silica, an MR fluid with an organoclay thickener typically will form a light gel at low volume concentrations, with a yield stress sufficient to prevent or significantly retard settling, but with an ability to flow with low to moderate viscosity. Moreover, the clay is inherently less abrasive than fumed silica, suggesting the possibility to reduce expensive surface treatments used to retard or prevent abrasion. However, organoclay thickeners typically require the use of dispersants such as propylene carbonate and there are some indications that propylene carbonate can result in a decrease in durability for the MR fluid. Accordingly, systems containing organoclays may exhibit poor durability performance due to the presence of dispersants in the organic clay.

MR fluids with 100% water atomized iron and conventional antiwear and antifriction additives may also exhibit unacceptable durability especially in demanding applications. Although not wishing to be bound by theory, it is theorized that the decreased durability in 100% water atomized iron MR fluid systems may be due to particle-particle attritions and/or particle-hardware attrition, resulting in particle fracture and the generation of fines and formation of virgin reactive iron surfaces. These effects can be mitigated to some extent by replacing some of the water atomized iron with soft carbonyl iron.

Therefore, a need exists for a durable MR fluid composition that utilizes a thickener or thixotropic agent that does not present the durability limitations associated with organoclays and/or dispersants such as propylene carbonate. Furthermore, it would be desirable to provide an MR fluid that is durable even though it is based on 100% water atomized iron with little, if any, carbonyl iron.

SUMMARY OF THE INVENTION

The present invention provides a magnetorheological fluid formulation comprising magnetizable particles dispersed in a carrier fluid and a thixotropic agent comprising a fluorocarbon grease wherein the thixotropic agent is effective to limit settling of the magnetized particles. In accordance with a particular aspect of the present invention, a magnetorheological fluid is provided containing an overbased metal sulfonate additive that improves durability of the formulation. There is further provided a method of making an MR fluid in which liquid vehicle components are blended together, the fluorocarbon grease is added to the blend, and magnetizable particles are suspended therein, resulting in a stable MR fluid of suitable viscosity and yield stress.

DETAILED DESCRIPTION

A durable magnetorheological (MR) fluid is disclosed. The MR fluid of the present invention is primarily used in a vibration dampening device such as a vibration damper and the like. The MR fluid includes magnetizable particles, a carrier fluid, and a thixotropic agent.

The MR fluid of the subject invention is durable in that the MR fluid performs acceptably in standard MR damper durability tests known to those skilled in the art. In one such durability test, an MR damper is filled with MR fluid and a side load of 100 Newtons is applied to the tube at the rod guide. With this side load applied to the tube, the MR fluid is 'durable' because there is (1) no significant rod seal leakage, (2) no significant gas cup seal leakage, and (3) no significant damping force variations over the duration of the durability test.

The magnetizable particles suitable for use in the fluids include magnetizable ferromagnetic, low coercivity (i.e., little or no residual magnetism when the magnetic field is removed), finely divided particles of iron, nickel, cobalt, iron-nickel alloys, iron-cobalt alloys, iron-silicon alloys and the like which are advantageously spherical or nearly spherical in shape and have a diameter in the range of about 1 to 100μ. In accordance with certain embodiments, the magnetizable particles are carbonyl or powdered iron. Because the particles are employed in noncolloidal suspensions, it is preferred that the particles be at the small end of the suitable range, preferably in the range of 1 to 10μ, more particularly in the range of 1 to 5μ, in nominal diameter or particle size. The magnetizable particles may also have a bimodal size distribution. For example, the magnetizable particles may be a mixture of spherical particles in the range of 1 to 100μ in diameter with two distinct particle size members present, one a relatively large particle size that is about 2 to 10 times the mean diameter of the relatively small particle size component.

In one embodiment, the magnetizable particles include iron. In a further embodiment, the magnetizable particles are selected from the group consisting of iron, iron oxide, iron nitride, iron carbide, reduced carbonyl iron, unreduced carbonyl iron, chromium dioxide, low carbon steel, silicon steel, nickel, cobalt, and combinations thereof.

In a particular embodiment, the magnetizable particles include water-atomized iron powder having a passivating oxide layer thereon as described in U.S. Pat. No. 6,787,058, the contents of which are hereby incorporated by reference. In the preferred embodiment, the magnetized particles comprise at least 50% water atomized iron particles. The iron powder in this aspect may be produced by a controlled, water atomization process. By "controlled" it is meant that the atomization parameters are selected so as to produce smooth, generally spherical particles of small diameter and narrow size distribution. One skilled in the art may appreciate that there are a number of key variables that influence the size and shape of the atomized particles. These variables include water or gas pressure, melt stream velocity and temperature, nozzle design, jet size, apex angle and water/metal ratios. By control of the various parameters, smooth, generally spherical iron particles may be obtained with a narrow size distribution and a mean diameter in the range of about 1 to 100μ, more particularly 5 to 20μ. Advantageously, the particle distribution range is between about 1μ and about 50μ. The particles are generally spherical, though not necessarily uniformly spherical. Exemplary high-pressure, water-atomized iron powders may be obtained from Hoeganaes Corp. (N.J.) and Hoganas AB (Sweden). Inert gas-atomized iron powders of the desired morphology and size are not generally available commercially due to the considerable expense of such powders compared to similar water-atomized particles, but would be suitable with respect to their properties if made available.

The atomized iron particles may be used in place of or in combination with carbonyl iron particles used in prior MR fluid formulations. The atomized iron powder may also be used with atomized magnetic stainless steel particles as disclosed in U.S. Pat. No. 6,679,999 entitled MR FLUIDS CONTAINING MAGNETIC STAINLESS STEELS, commonly owned, and incorporated by reference herein in its entirety. Thus, the MR fluid of the present invention may comprise magnetizable particles dispersed in a liquid vehicle, wherein the magnetizable particles comprise atomized powdered iron alone or in combination with one or both of atomized stainless steel powder and carbonyl iron powder.

In yet a further embodiment of the subject invention, the magnetizable particles include unreduced carbonyl iron. In this embodiment, the unreduced carbonyl iron has a particle size less than about 5 microns and a Rockwell B hardness of at least 50. In even a further embodiment of the subject invention, the magnetizable particles include reduced carbonyl iron. In this embodiment, the reduced carbonyl iron has a particle size less than about 10 microns and a Rockwell B hardness less than 50. It is also possible that, in certain embodiments, the magnetizable particles include an iron alloy. In these embodiments where an iron alloy is present, the iron alloy includes iron and an element selected from the group consisting of aluminum, silicon, cobalt, nickel, vanadium, molybdenum, chromium, tungsten, manganese, copper, and combinations thereof.

Examples of useful carbonyl irons include, but are not limited to, BASF grades HS, HL, HM, HF, and HQ, and International Specialty Products (ISP) grades S-3700, S-1640, and S-2701. A non-limiting example of a useful iron-cobalt alloy is Carpenter Technology grade HYPERCO™.

Although pure iron is soft and ductile, the hardness of iron may be increased by the addition of small quantities of impurities such as nitrogen, carbon, and oxygen. For example, "soft-grade" reduced carbonyl iron such as BASF grade CM contains 0.008% carbon, less than 0.01% nitrogen, and 0.2% oxygen, whereas "hard-grade" unreduced carbonyl iron such as BASF grade HS contains 0.74% carbon, 0.78% nitrogen, and less than 0.5% oxygen.

In any embodiment, it is preferred that the magnetizable particles are present in the MR fluid in an amount from 30 to 93, more preferably from 60 to 80, parts by weight based on 100 parts by weight of the durable MR fluid.

The carrier component is a fluid that forms the continuous phase of the magnetorheological fluid. The carrier fluid used to form a magnetorheological fluid from the magnetorheological compositions of the invention may be any of the vehicles or carrier fluids known for use with magnetorheological fluids. If the magnetorheological fluid is to be an aqueous fluid, one of skill in the art will understand which of the additives disclosed herein are suitable for such systems. Aqueous systems are described, for example, in U.S. Pat. No.

5,670,077, incorporated herein by reference in its entirety. Where a water-based system is used, the magnetorheological fluid formed may optionally contain one or more of an appropriate thixotropic agent, an anti-freeze component or a rust-inhibiting agent, among others.

In accordance with certain embodiments, the carrier fluid will be an organic fluid, or an oil-based fluid. Suitable carrier fluids which may be used include cycloparaffin oils, paraffin oils, natural fatty oils, mineral oils, polyphenylethers, dibasic acid esters, neopentylpolyol esters, phosphate esters, polyesters, synthetic cycloparaffin oils and synthetic paraffin oils, unsaturated hydrocarbon oils, monobasic acid esters, glycol esters and ethers, silicate esters, silicone oils, silicone copolymers, synthetic hydrocarbon oils, perfluorinated polyethers and esters and halogenated hydrocarbons, and mixtures or blends thereof. Hydrocarbon oils, such as mineral oils, paraffin oils, cycloparaffin oils (also known as naphthenic oils) and synthetic hydrocarbon oils are particularly useful classes of carrier fluids. The synthetic hydrocarbon oils include those oils derived from oligomerization of olefins such as polybutenes and oils derived from high alpha olefins of from 8 to 20 carbon atoms by acid catalyzed dimerization and by oligomerization using trialuminum alkyls as catalysts. Such poly-α-olefin oils are particularly useful carrier fluids.

The carrier fluid of the present invention is typically utilized in an amount ranging from about 50 to about 95, preferably from about 70 to 90, parts by weight of the liquid phase of the MR fluid.

The carrier fluid in certain embodiments may include a polyalphaolefin (PAO) and a plasticizer. In accordance with certain aspects of the invention, the PAO is present in the MR fluid in an amount from 5 to 30, more preferably from 15 to 25 parts by weight based on 100 parts by weight of the durable MR fluid. Preferably, the plasticizer is present in the MR fluid in an amount from 2 to 25, more preferably from 2 to 10, parts by weight based on 100 parts by weight of the durable MR fluid. In terms of volume percentages, the carrier fluid includes about 50-90% by volume polyalphaolefin (PAO) and about 10-50% by volume plasticizer.

In one embodiment of the subject invention, the PAO includes dodecene. In a further embodiment, the PAO is selected from the group consisting of monomers of decene, dimers of decene, trimers of decene, tetramers of decene, monomers of dodecene, dimers of dodecene, trimers of dodecene, tetramers of dodecene, and combinations thereof. In any embodiment of the subject invention, the carrier fluid may further include at least one of cycloparaffin oils, paraffin oils, natural fatty oils, mineral oils, polyphenylethers, synthetic cycloparaffin oils, synthetic paraffin oils, unsaturated hydrocarbon oils, silicone oils, silicone copolymers, synthetic hydrocarbon oils, and perfluorinated polyethers and esters and halogenated hydrocarbons. The most preferred PAO is a dimer of dodecene. Examples of preferred PAOs include, but are not limited to, Chevron Synfluid™ 2.5 (a dimer of 1-dodecene), Chevron Synfluid™ 2 (a dimer of decene), Chevron Synfluid™ 4 (a trimer of decene), Mobil PAO SHF 21 (a dimer of decene), Mobil PAO SHF 41 (a trimer of decene), and Amoco Durasyn™ 170.

In accordance with one aspect of the invention, the plasticizer is selected from the group consisting of monobasic acid esters, dibasic acid esters, glycol esters, glycol ethers, silicate esters, neopentylpolyol esters, phosphate esters, polyesters, dioctyl sebacates, dioctyl adipates, mixed alkyl adipate diesters, polyol esters, and combinations thereof. A particularly useful plasticizer is dioctyl sebacate. The plasticizer of the subject invention that is incorporated into the carrier fluid provides seal swell. Examples of suitable plasticizers include, but are not limited to, UNIFLEX™ DOS, UNIFLEX™ DOA, UNIFLEX™ 250 and UNIFLEX™ 207-D, all commercially available from Arizona Chemical.

As initially described above, the MR fluid includes one or more thixotropic agents or thickeners. At least one of the thixotropic agents comprises a fluorocarbon grease. The fluorocarbon grease is useful as thixotropic agent in accordance with certain aspects of the present invention and comprises a base oil and a fluorocarbon thickener. The base oil usable herein is not restricted to specific ones and may be, for example, animal oils, vegetable oils, mineral oils and synthetic lubricating oils. Preferably, the base oil is a synthetic hydrocarbon oil compatible with the carrier fluid of the MR fluid formulation. In accordance with particular embodiments of the present invention, the base oil comprises a polyalphaolefin (PAO).

The fluorocarbon thickeners usable in the present invention include fluorocarbon polymers such as polytetrafluoroethylene (PTFE), chlorofluorocarbon, perchlorofluorocarbon, and other halocarbon thickeners and mixtures thereof. Commercial fluorocarbon greases that may be useful in the present invention include, without limitation, Nye fluorocarbon grease 855, 855D, 866, available from Nye Lubricants, MA. Furthermore, the fluorocarbon grease may be added to the MR fluid formulation as a prepared grease composition or the grease composition may be formed in situ. The fluorocarbon grease thickener provides the necessary anti-settling characteristics to the MR fluid, while avoiding the potentially detrimental effects associated with using an organoclay thickener and dispersing agent such as propylene carbonate. Furthermore, the fluorocarbon thickener can act as a lubricating agent and thereby mitigate particle attrition in MR fluids containing 100% water atomized powder. Additionally, anti-wear or antifriction additives can be reduced or eliminated since the fluorocarbon thickener provides these functions.

The National Lubricating Grease Institute (NLGI) provides a standard to assess viscosity levels. For example, a lubricant having an NLGI grade of 1 has the viscosity of a semisolid liquid, whereas a lubricant having an NLGI grade of 3 has the viscosity of a thick paste. Preferably, the fluorocarbon grease has an NLGI grade of between about 1 and about 3; more preferably, the fluorocarbon grease has an NLGI grade of between about 1.5 and about 2.5, and more preferably still, the fluorocarbon grease has an NLGI grade of between about 1.75 and about 2.25.

Although certain aspects of the present invention relate to MR fluid formulations wherein a fluorocarbon grease is the only thixotropic agent, other embodiments of the present invention may include other thixotropic agents in addition to the fluorocarbon grease. Examples of conventional thixotropic materials that may also be included in the MR fluid formulation include, without limitation, precipitated silica, fumed silica, an organoclay, a metal soap complex and mixtures thereof. In accordance with particular embodiments of the present invention, conventional thixotropic materials, if present, may be present in an amount below an efficacious amount. In other words, in accordance with these embodiments, the conventional thixotropic material is present at concentrations insufficient to provide the necessary stabilization of the MR fluid in the absence of the fluorocarbon grease. Alternatively, in accordance with other embodiments of the invention, the conventional thixotropic material may be present in an amount that is sufficient to stabilize the MR fluid even in the absence of the fluorocarbon grease. As used herein, the term "efficacious amount" refers to an amount of thixotropic agent capable of stabilizing the MR fluid in the absence of other thixotropic agents so as to prevent unacceptable levels of settling. In accordance with other embodiments of the present invention, the MR fluid formulation is substantially free of conventional thixotropic materials such as precipitated silica, fumed silica, organoclays, metal soaps, and metal soap complexes. As used herein, the term "substantially free" means that no more than an amount 0.5%, more particularly 0.2%, and down to and including 0% of a conventional thixotropic agent by weight, based on the total weight of the MR fluid formulation, is present in the MR fluid formulation.

In accordance with particular embodiments of the present invention, the MR fluid formulation contains conventional thixotropic agents in addition to the fluorocarbon grease such as fumed silicas and organoclays. The fumed silica can be treated fumed silica or untreated fumed silica. Particularly useful fumed silica has a surface area between about 250 to 450 $m^2$ per g, more particularly between about 300 and 400 $m^2$ per g. Examples of untreated fumed silica include, but are not limited to, CAB-O-SIL® grades EH-5, HS-5, H-5 and MS-55, available from Cabot Corporation.

The MR fluid formulation may also include organoclays. The organoclay is formed by the reaction of a organic cation with smectite clay. The organic cation typically is quaternary ammonium chloride. A particularly useful organoclay is CLAYTONE® EM commercially available from Southern Clay Products, Inc. of Gonzales, Tex. Another useful organoclay is GARAMITE® LS also available from Southern Clay Products.

In any embodiment, it is preferred that the thixotropic agent, including the fluorocarbon grease and any conventional thixotropic agent, is present in the MR fluid in an amount from about 0.05 to 10, more particularly from about 0.5 to 6, and in certain embodiments from about 1 to 5 parts by weight based on 100 parts by weight of the durable MR fluid. The thixotropic agent is typically present in an amount of from about 20% to 50%, more particularly from about 20 to 40% and in accordance with certain embodiments from about 25% to 35% by weight based on the liquid phase of the MR fluid.

Advantageously, the thixotropic agent is provided in a relative concentration chosen to optimize key suspension properties, such as settling, viscosity, and MR effect.

MR fluid formulations containing only water atomized iron powder can exhibit less than desirable durability. Durability can be improved by replacing some of the water atomized iron powder with carbonyl iron powder. Although not wishing to be bound by theory, it is believed that the mechanically soft carbonyl iron deforms under stress rather than breaking. This prevents the formation of fine iron particles and reduces the generation of virgin iron surfaces that can result from iron particles breaking. Soft carbonyl iron powder particles may also form a buffer that prevents the harder water-atomized iron particles from breaking during impacts with the shock absorbers surfaces or with other water-atomized iron particles. Furthermore, the large number of hydroxyl groups on the surface of the carbonyl iron particles can react with acids and other products formed by the decomposition of MR fluid liquid components. This effectively prevents the decomposition products from reacting further with other MR fluid components and causing chemical breakdown of the MR fluid. Although carbonyl iron is effective for improving durability of these MR fluid formulations, the relative expense of carbonyl iron is a drawback.

An overbased metal sulfonate additive can be included in the formulation as a low cost substitute for carbonyl iron to provide an excess of hydroxyl functionality. Accordingly, one aspect of the present invention relates to a formulation containing an overbased metal sulfonate additive. The level of additive is based on the number of —OH groups on the surface of the carbonyl iron, the specific surface area of the carbonyl iron powder, the total base number of the overbased additive, and the molecular weight of the reference base used in calculating the total base number of the overbased additive.

Examples of the aromatic sulfonic acid salts used in this aspect of the present invention are metal salts of, for instance, benzenesulfonic acid and naphthalenesulfonic acid such as alkali metal salts and alkaline earth metal salts thereof (e.g., lithium dinonylnaphthalenesulfonate). These compounds are rust inhibitors and may be commercially available from KING INDUSTRY Company under the trade name of, for instance, NA-SUL 707 and NA-SUL CA 50. NA-SUL CA 50 is a particularly useful overbased calcium sulfonate additive that can be added at concentrations from 1 to about 60 grams per liter of MR fluid, more particularly from about 5 to about 40 grams per liter, still more particularly from about 10 to about 30 grams per liter and more specifically from about 20 to about 30 grams per liter of MR fluid. A concentration of about 30 grams per liter of MR fluid is calculated as being equivalent to a 50/50 carbonyl iron/water atomized blend.

In accordance with certain aspects of the present invention, a typical MR fluid formulation with NA SUL CA 50 at a concentration of 30 g/liter MR fluid could include the following components in the amounts listed where percentages by weight are based on the MR fluid formulation:

- Magnetizable solid: 50-90% by weight, preferably spherical or near-spherical morphology, with mean diameter of between 1 to 100 microns, with a preferred range of 5 to 20 microns.
- Base liquid: 5-50% by weight, Mineral oil, synthetic hydrocarbons, esters, diesters, silicone oils, glycols.
- Thixotropic agent: 0.05-10% by weight, fluorocarbon grease, organoclays, fumed silicas, precipitated silicas, polyureas, alkali soaps.
- Additive package:
  - 0.025-1.5% by weight Organomolybdenum dithiocarbamate,
  - 0.025-1.5% by weight Ashless dithiocarbamate,
  - 0.0025-0.225% by weight Tolutriazole compound, and optionally
  - 0.0025-0.1% by weight Alkylated diphenylamine.
  - NA SUL CA50 at 30 g/liter of MRF Preferred additives include but are not limited to:

Organomolybdenum dithiocarbamate: Molyvan 822 (R.T. Vanderbilt)

Ashless Dithiocarbamate Methylene bis(dibutyl dithiocarbamate) Vanlube 7723 (R.T. Vanderbilt)

Tolutriazole compound: Vanlube 887, Vanlube 887E (R.T. Vanderbilt)

Alkylated diphenylamine: Vanlube 961 (R.T. Vanderbilt)

Various additives may be included in the MR fluid formulations. For example, in the exemplary shock absorber application, the formulation may include anti-wear and anti-friction additives in the amount of about 0.5 to 3% by volume. Examples of such additives include an organomolybdenum complex, such as Molyvan® 855, an organomolybdenum thiocarbamate, such as Molyvan® 822, and an organo-thiocarbamate, such as Vanlube® 7723, each of which is available commercially from R. T. Vanderbilt Co., Inc., Norwalk, Conn. Because gelation is dependent on particle-particle interactions, and these in turn are highly dependent on surface chemistry, the presence of additives in the fluid formulation, such as antioxidants and lubricity aids.

As stated above, particular mention has been made of shock absorbers for land-based vehicles. Other devices include, but are not limited to: brakes, pistons, clutches, dampers, exercise equipment, controllable composite structures and structural elements. Particular mention has also been made of PAO and DOS, and of Nye fluorocarbon Grease 855D as exemplary components of the MR fluid system. It should be understood, however, that there are numerous other liquid vehicle components and greases that may be used in accordance with the present invention. It should be further understood that the present invention is not limited to a two-component system. The base liquid vehicle may contain a mixture of one or more liquid components.

In all embodiments, the MR fluid may optionally include an anti-wear additive. The MR fluid may also optionally include an anti-friction additive. If included, the anti-wear additive is preferably an organo-dithiocarbamate or a zinc dialkyl dithiophosphate (ZDDP) and the anti-friction additive is preferably an organomolybdenum compound. The amount of each of these additives present in the MR fluid is dependent upon the total weight of the PAO and the plasticizer, the primary liquid components. It is contemplated that the weight fraction of the anti-wear additive to the PAO and the plasticizer should be in the range of 0 to about 0.03 and the weight fraction of the anti-friction additive to the PAO and the plasticizer should be in the range of 0 to about 0.03. Examples of anti-wear agents include Vanlube™ 7723 available from R. T. Vanderbilt Company and ZDDP such as available from Lubrizol Corporation (e.g., grades 1395 and 677A) and Ethyl Corporation (e.g., grades HiTEC™ 7197 and HiTEC™ 680). Examples of anti-friction agents include organomolybdenum compounds (MOLY) such as NAUGALUBE™ MOLYFM 2543 commercially available from C. K. Witco and MOLYVAN™ 855 available from R. T. Vanderbilt Company and alkyl amine oleates.

The following examples illustrating the formation of the MR fluid, as presented herein, are intended to illustrate and not limit the invention.

ILLUSTRATIVE EXAMPLE 1

An MR fluid containing 40 gm of the PTFE grease in a synthetic hydrocarbon oil was mixed with an additional 40 g of PAO SHF41 synthetic oil and 185.2 gm of BASF CM iron carbonyl iron powder. The MR fluid (3SMY137) had a viscosity of 141.3 cP at 40° C. The MR fluid was allowed to sit in a glass jar.

ILLUSTRATIVE EXAMPLE 2

An MR fluid containing 20 gm of the PTFE grease in a synthetic hydrocarbon oil was mixed with an additional 60 g of PAO SHF41 synthetic oil and 187.5 gm of BASF CM iron powder. The MR fluid (3SMY138) had a viscosity of 67.4 cP at 40° C. The MR fluid was allowed to sit in a glass jar.

After one week of settling time on the lab bench, Sample 1 exhibited a very small layer of clear fluid of less than 5% of the total height of the MR fluid. Sample 2 had a clear fluid layer that was less than 15% of the total height of the MR fluid. Both samples were easily re-mixed, with no evidence of settling of the iron powder.

ILLUSTRATIVE EXAMPLE 3

A particularly useful embodiment for the claimed MR fluid formulation is as follows:

| | |
|---|---|
| Hoeganaes RFM Grade II | 74.67 wt % |
| Fluorocarbon Grease (+optional thickener) | 7.13 wt % |
| PAO 2.5 | 12.05 wt % |
| Uniflex DOS | 4.35 wt % |
| Molyvan 822 | 0.29 wt % |
| Vanlube 996e | 0.37 wt % |
| Vanlube 961 | 0.04 wt % |
| NA SUL CA50 | 1.01 wt % |

While the present invention has been illustrated by the description of an embodiment thereof, and while the embodiment has been described in considerable detail, it is not intended to restrict or in any way limit the scope of the appended claims to such detail. Additional advantages and modifications will readily appear to those skilled in the art. The invention in its broader aspects is therefore not limited to the specific details, representative apparatus and method and illustrative examples shown and described. Accordingly, departures may be made from such details without departing from the scope or spirit of applicant's general inventive concept.

What is claimed is:

1. A durable magnetorheological fluid formulation comprising:

a carrier fluid, magnetizable particles dispersed in the carrier fluid, a conventional thixotropic agent below an efficacious amount, and a fluorocarbon grease wherein said fluorocarbon grease is effective to limit settling of the magnetizable particles.

2. The formulation of claim 1 wherein the fluorocarbon grease comprises a fluorocarbon polymer and a base oil.

3. The formulation of claim 2 wherein the fluorocarbon polymer comprises polytetrafluoroethylene.

4. The formulation of claim 1 wherein said conventional thixotropic agent is selected from the group consisting of precipitated silica, fumed silica, an organoclay, a metal soap, a metal soap complex and mixtures thereof.

5. The formulation of claim 1 wherein the formulation is substantially free of said conventional thixotropic agent selected from the group consisting of precipitated silica, fumed silica, an organoclay, a metal soap, and a metal soap complex.

6. The formulation of claim 1 wherein the carrier fluid is selected from the group consisting of natural fatty oils, mineral oils, polyphenylethers, dibasic acid esters, neopentylpolyol esters, phosphate esters, synthetic cycloparaffins, synthetic paraffins, unsaturated hydrocarbon oils, monobasic acid esters, glycol esters, glycol ethers, silicate esters, silicon oils, silicon copolymers, synthetic hydrocarbons, perfluorinated polyethers and esters, halogenated hydrocarbons, and mixtures thereof.

7. The formulation of claim 1 wherein the carrier fluid includes about 50-90% by volume polyalphaolefin and about 10-50% by volume dioctyl sebacate.

8. The formulation of claim 1 wherein the fluorocarbon grease has an NLGI grade of between about 1 and 3.

9. The formulation of claim 1 further comprising at least one additive selected from the group consisting of an organomolybdenum complex, an organomolybdenum thiocarbamate, and an organothiocarbamate.

10. A durable magnetorheological fluid formulation comprising:

a carrier fluid, magnetizable particles dispersed in the carrier fluid wherein the magnetizable particles comprise water atomized iron powder, a conventional thixotropic agent below an efficacious amount, and a fluorocarbon grease wherein said fluorocarbon grease has an NLGI grade of between 1 and 3 and is effective to limit settling of the magnetizable particles.

11. The formulation of claim 10 wherein the carrier fluid comprises a polyalphaolefin and diotyle sebacate.

12. The formulation of claim 10 wherein the magnetizable particles comprise at least 50% water atomized iron powder.

13. The formulation of claim 10 wherein the fluid formulation further comprises an overbased sulfonate additive.

14. The formulation of claim 13 wherein the overbased sulfonate additive is present in an amount of from about 10 to 30 grams per liter based on total volume of the magnetorheological fluid formulation.

15. The formulation of claim 11 wherein the carrier fluid comprises about 50-90% by volume polyalphaolefin and about 10-50% by volume dioctyl sebacate.

16. The formulation of claim 10 wherein the fluorocarbon grease comprises polytetrafluoroethylene.

17. The formulation of claim 10 wherein said conventional thixotropic agent is selected from the group consisting of precipitated silica, fumed silica, an organoclay, a metal soap, a metal soap complex and mixtures thereof.

18. The formulation of claim 10 wherein the formulation is substantially free of said conventional thixotropic agent selected from the group consisting of precipitated silica, fumed silica, an organoclay, a metal soap, and a metal soap complex.

19. The formulation of claim 10 further comprising at least one additive selected from the group consisting of an organomolybdenum complex, an organomolybdenum thiocarbamate, and an organothiocarbamate.

20. A method of making an MR fluid comprising:

blending a carrier fluid including a polyalphaolefin and a plasticizer, adding a fluorocarbon grease having an NLGI grade of between about 1 and 3, and dispersing magnetizable particles in the carrier fluid.

21. The method of claim 20 wherein blending the carrier fluid comprises blending about 50-90% by volume polyalphaolefin with about 10-50% by volume plasticizer.

22. The method of claim 20 wherein the thixotropic agent is added in an amount of about 20 to 40% by weight of the carrier fluid.

23. The method of claim 20 further comprising adding an overbased sulfonate additive.

* * * * *